US007032331B2

(12) United States Patent
Tsai

(10) Patent No.: US 7,032,331 B2
(45) Date of Patent: Apr. 25, 2006

(54) ILLUMINATING HEEL FOR A SHOE

(75) Inventor: Cheng-Yang Tsai, 13F, No. 152, Sec. 1, Nantun Rd., Taichung (TW)

(73) Assignees: Kuo-Hsun Wu, Taichung (TW); Wen-Yu Chiu, Changhua Hsien (TW); Cheng-Yang Tsai, Taichung (TW)

( * ) Notice: Subject to any disclaimer, the term of this patent is extended or adjusted under 35 U.S.C. 154(b) by 147 days.

(21) Appl. No.: 10/833,629

(22) Filed: Apr. 27, 2004

(65) Prior Publication Data

US 2005/0235528 A1 Oct. 27, 2005

(51) Int. Cl.
*A43B 23/00* (2006.01)

(52) U.S. Cl. ..... 36/137; 362/103

(58) Field of Classification Search ..... 36/136, 36/137; 362/103
See application file for complete search history.

(56) References Cited

U.S. PATENT DOCUMENTS 4,128,861 A * 12/1978 Pelengaris ..... 362/103
5,303,131 A * 4/1994 Wu ..... 362/103
5,396,720 A * 3/1995 Hwang et al. ..... 36/137
5,419,061 A * 5/1995 Barrocas ..... 36/137
5,732,486 A * 3/1998 Rapisarda ..... 36/137
6,104,140 A * 8/2000 Wut et al. ..... 315/200 A
6,280,045 B1 * 8/2001 Anteby et al. ..... 362/103

* cited by examiner

*Primary Examiner*—M. D. Patterson
(74) *Attorney, Agent, or Firm*—Alan D. Kamrath; Nikolai & Mersereau, P.A.

(57) ABSTRACT

A heel has a body, a circuit board, multiple illuminating elements, an integrated circuit unit, a power source, a switch, a push button and a cover. The body is permeable to light and has a recess. The circuit board is received in the recess. The illuminating elements are mounted on the circuit board. The integrated circuit unit is mounted on the circuit board and is electrically connected to the illuminating elements. The power source is electrically connected to the illuminating elements through the integrated circuit unit. The switch is electrically connected between the power source and the integrated circuit unit. The push button abuts against the switch to actuate the switch when the push button is pushed. The cover is attached to the body and has a bore defined through the cover for the push button extending out from the bore.

6 Claims, 4 Drawing Sheets

ILLUMINATING HEEL FOR A SHOE

BACKGROUND OF THE INVENTION

1. Field of the Invention

The present invention relates to a heel for a shoe, and more particularly to an illuminating heel for a shoe and that can show different illuminating effects.

2. Description of Related Art

Shoes not only provide a protection effect to feet but also provide a decorative effect. Therefore, the shoes are always designed to have different appearances to fit with different user's needs and to add attraction to the users. However, it is most common to design different appearances to a conventional shoe at the front of the shoe rather than at the heel. In addition, the change at the appearance of the front of the conventional shoe is always limited to a contour or configuration but not at an illuminating effect. Therefore, the appearance of a conventional shoe is not versatile and is no longer sufficiently attractive.

To overcome the shortcomings, the present invention tends to provide an illuminating heel to mitigate or obviate the aforementioned problems.

SUMMARY OF THE INVENTION

The main objective of the invention is to provide a heel that can provide a changeable illuminating effect to add attraction of a shoe with the heel. The heel has a body, a circuit board, multiple illuminating elements, an integrated circuit (IC) unit, a power source, a switch, a push button and a cover. The body is permeable to light and has a recess with an inner surface and two channels defined in the inner surface of the recess respectively at two sides of the inner surface. The circuit board is received in the recess and has two edges received espectively in the channels. The illuminating elements are mounted on the circuit board. The integrated circuit (IC) unit is mounted on the circuit board and is electrically connected to the illuminating elements. The power source is electrically connected to the illuminating elements through the integrated circuit unit to provide an electrical power to the illuminating elements. The switch is electrically connected between the power source and the integrated circuit unit. The push button abuts against the switch to switch the switch when the push button is pushed. The cover is attached to the body to close the recess and has a bore defined through the cover for the push button extending out from the bore.

Other objects, advantages and novel features of the invention will become more apparent from the following detailed description when taken in conjunction with the accompanying drawings.

DETAILED DESCRIPTION OF PREFERRED EMBODIMENT

Figure 1:
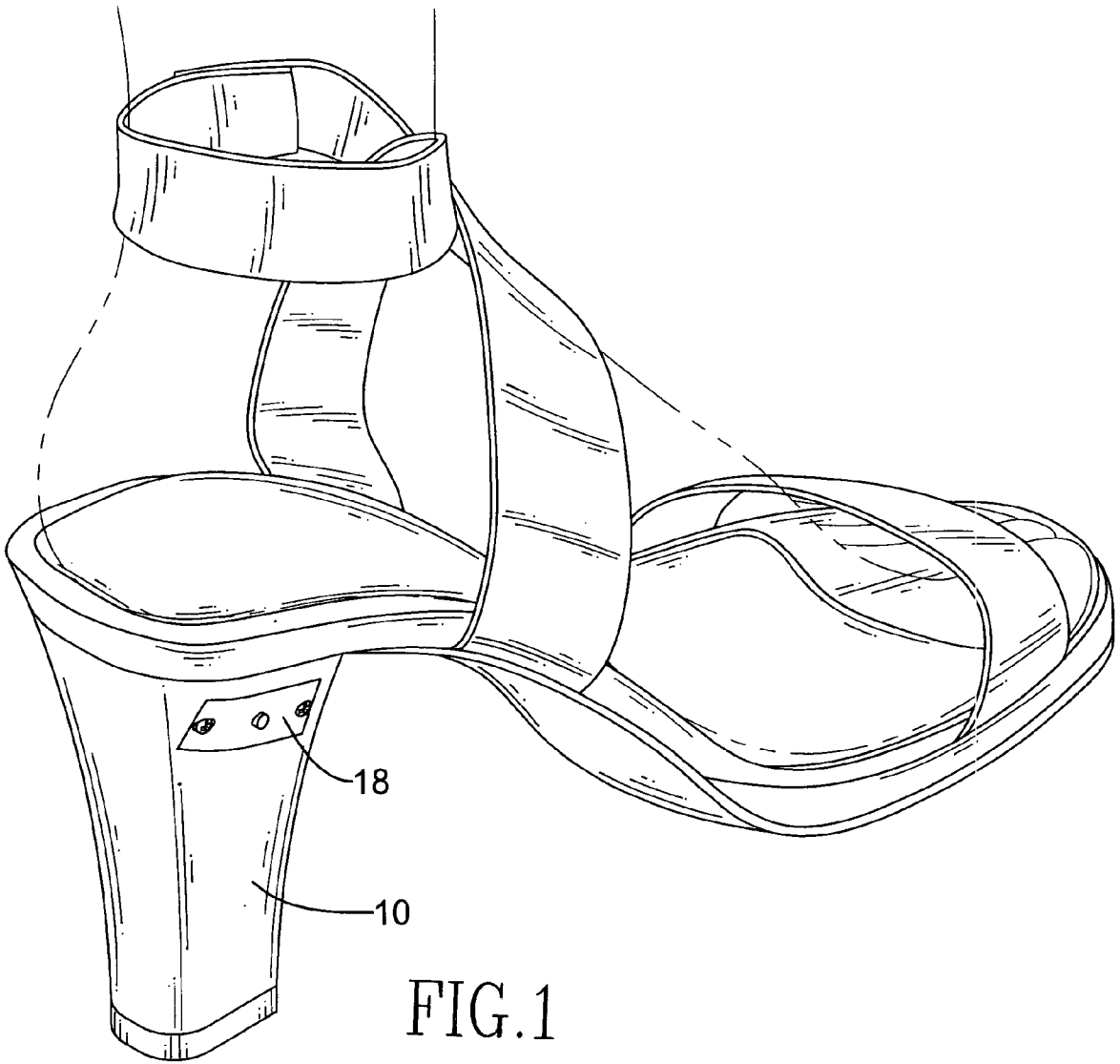
FIG. 1 is a perspective view of a shoe with a heel in accordance with the present invention.
Figure 2:
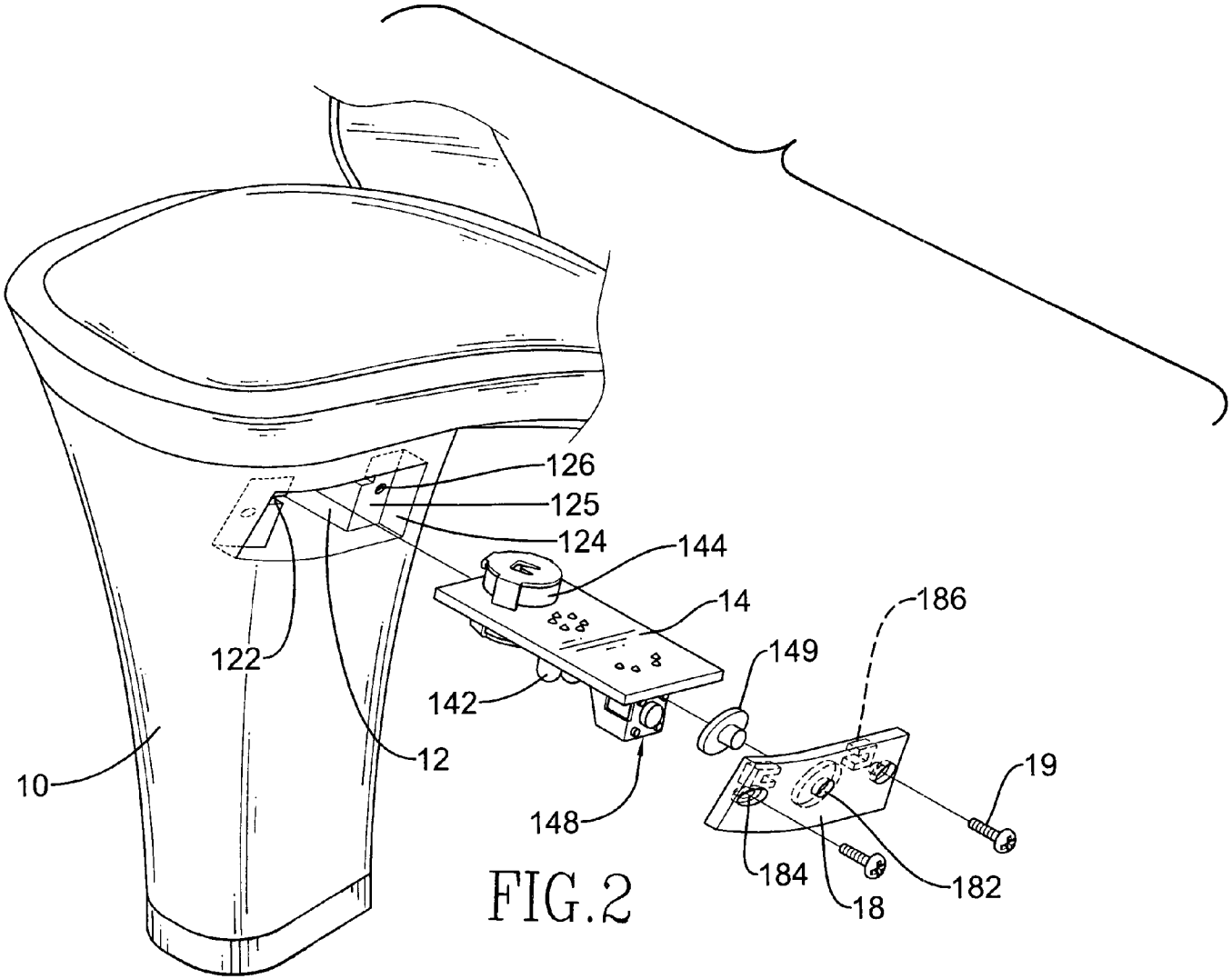
FIG. 2 is an exploded perspective view of the heel in FIG. 1.
Figure 3:
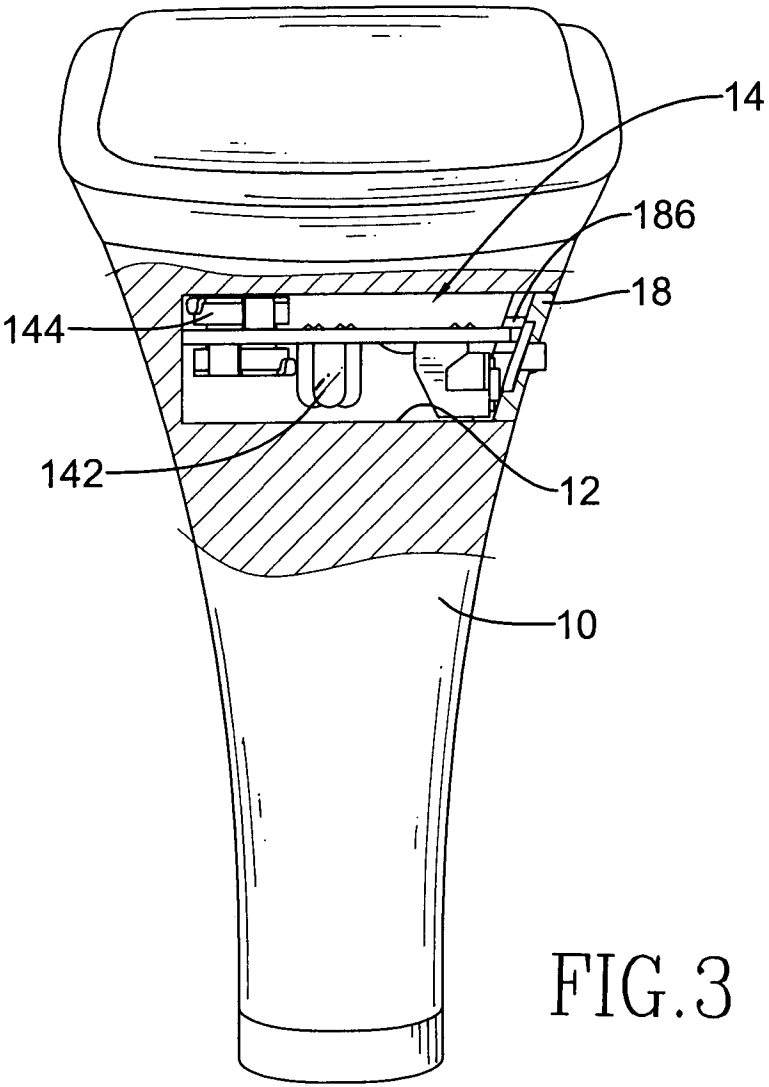
FIG. 3 is an end plan view in partial cross section of the heel in FIG. 1.
Figure 4:
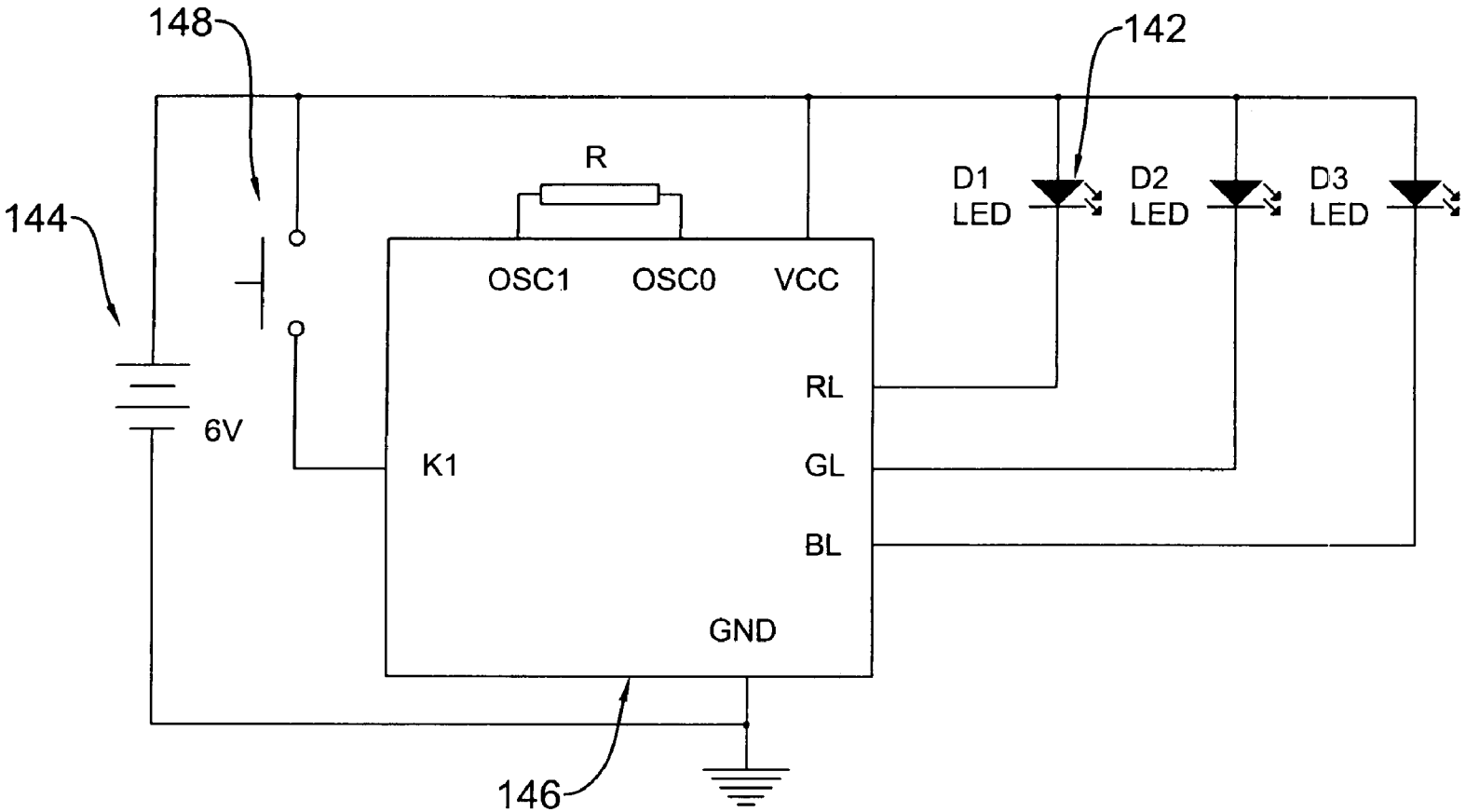
FIG. 4 is a circuit diagram of the circuit on the circuit board of the heel in FIG. 1.

With reference to FIGS. 1 to 4, a heel for a shoe in accordance with the present invention comprises a body (10), a circuit board (14), multiple illuminating elements (142), an integrated circuit (IC) unit (146), a power source (144), a switch (148), a push button (149) and a cover (18). The body (10) has a permeability to light, a recess (12) and two channels (122). The recess (12) is defined in the body (10) and has an inner surface. The channels (122) are defined in the inner surface of the recess (12) respectively at two sides of the inner surface. In addition, an opening (124) is defined in the body (10) and communicates with the recess (12). The opening (124) has a width larger than that of the recess (12) to form two shoulders (125) respectively at two sides of the recess (12).

The circuit board (14) is received in the recess (12) and has two edges received respectively in the channels (122), such that the circuit board (14) can slide into the recess (12) along the channels (122).

The illuminating elements (142) are mounted on the circuit board (14). In a preferable embodiment, the illuminating elements are light emitting diodes (LEDs) and can show different colors. The integrated circuit (IC) unit (146) is mounted on the circuit board (14) and is electrically connected to the illuminating elements (142) to light up the illuminating elements (142) in alternative manners. That is, a first sequence of lights may be actuated, and then other subsequent sequences can be triggered after a certain duration of the first sequence. The power source (144) is electrically connected to the illuminating elements (142) through the integrated circuit unit (146) to provide an electrical power to the illuminating elements (142). In an optional embodiment, the power source (144) is a battery. The switch (148) is electrically connected between the power source (144) and the integrated circuit unit (146). The push button (149) abuts against the switch (148) to actuate the switch (148) when the push button (149) is pushed.

The cover (18) is attached to the body (10) to close the recess (12). With the arrangement of the opening (124), the cover (18) is received in the opening to make the cover (18) flush with the outer surface of the body (10). To secure the cover (18) to the body (10), each shoulder (125) has a threaded hole (126) defined in the shoulder (125), and the cover (18) has two through holes (184) defined through the cover (18) and aligning respectively with the threaded holes (126) in the shoulders (125). Two screws (19) penetrate respectively through the through holes (184) in the cover (18) and are screwed respectively into the threaded holes (126) in the shoulders (125). With the arrangement of the cover (18), the circuit board (14), the switch (148) and the push button (149) are securely held in the recess (12) and will not escape from the recess (12) arbitrarily.

The cover (18) has a bore (182) defined through the cover (18) for the push button (149) extending out from the bore (182), such that the user can conveniently push the push button (182). The cover (18) further has two clamps (186) to clamp one end of the circuit board (14). After releasing the screws (19) from the threaded holes (126), the cover (18) can be detached from the body (10) to open the recess (12). With the arrangements of the clamps (186), the circuit board (14) will be simultaneously taken out of the recess (12) when the cover (18) is detached from the body (10). Accordingly, to replace an exhausted battery with a new one is convenient and easy.

When the push button (149) is pushed, the switch (148) will be turned on and at least one of the illuminating elements (142) will be actuated to light up by the integrated circuit unit (146). With the illuminating effect provided by the lighting illuminating elements (142), a visual decorative effect is provided. When the push button (149) is pushed again, the switch (148) will be turned off and the lighting illuminating elements (142) will also be turned off.

If the user pushes the push button (149) again, the integrated circuit unit (146) will light different the illuminating elements (142) up. With different colored lights emitted by the illuminating elements (142), a various and versatile visual decorative effect is provided. Accordingly, a changeable illuminating effect provided by the illuminating elements (142) will be provided in an alternative manner by means of pushing the push button (149). Consequently, the heel can provide a changeable illuminating decorative effect, and a shoe with a heel in accordance with the present invention is attractive to consumers.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heel for a shoe comprising:

a body with a permeability to light having a recess with an inner surface defined in the body and two channels defined in the inner surface of the recess respectively at two sides of the inner surface;

a circuit board received in the recess and having two edges received respectively in the channels;

multiple illuminating elements mounted on the circuit board;

an integrated circuit (IC) unit mounted on the circuit board and electrically connected to the illuminating elements;

a power source electrically connected to the illuminating elements through the integrated circuit unit to provide an electrical power to the illuminating elements;

a switch electrically connected between the power source and the integrated circuit unit;

a push button abutting against the switch to actuate the switch when the push button is pushed; and a cover attached to the body to close the recess and having a bore defined through the cover for the push button extending out from the bore.

2. The heel as claimed in claim 1 further comprising an opening defined in the body and communicating with the recess to receive the cover in the opening, wherein the opening has a width larger than that of the recess to form two shoulders at two sides of the recess.

3. The heel as claimed in claim 2, wherein each shoulder has a threaded hole defined in the shoulder;

the cover has two through holes defined through the cover and aligning respectively with the threaded holes in the shoulders; and two screws penetrating respectively through the through holes in the cover and screwed respectively into the threaded holes in the shoulders.

4. The heel as claimed in claim 3, wherein the cover further has two clamps to clamp one end of the circuit board.

5. The heel as claimed in claim 2, wherein the cover further has two clamps to clamp one end of the circuit board.

6. The heel as claimed in claim 1, wherein the cover further has two clamps to clamp one end of the circuit board.

* * * * *